US009303843B2

(12) United States Patent
Kaule et al.

(10) Patent No.: US 9,303,843 B2
(45) Date of Patent: Apr. 5, 2016

(54) LIGHTING ASSEMBLY

(71) Applicant: Kohler Co., Kohler, WI (US)

(72) Inventors: Brian Kaule, Yardley, PA (US); James Stanley, Levittown, PA (US); James A. DeHope, Hatboro, PA (US)

(73) Assignee: ROBERN, INC., Bristol, PA (US)

( * ) Notice: Subject to any disclaimer, the term of this patent is extended or adjusted under 35 U.S.C. 154(b) by 276 days.

(21) Appl. No.: 13/801,043

(22) Filed: Mar. 13, 2013

(65) Prior Publication Data

US 2013/0279156 A1 Oct. 24, 2013

Related U.S. Application Data

(60) Provisional application No. 61/637,169, filed on Apr. 23, 2012.

(51) Int. Cl.

| | |
|---|---|
| ***F21V 13/04*** | (2006.01) |
| ***F21V 33/00*** | (2006.01) |
| ***F21V 5/04*** | (2006.01) |
| ***F21V 15/01*** | (2006.01) |
| *F21V 9/08* | (2006.01) |
| *F21V 13/14* | (2006.01) |
| *F21V 15/015* | (2006.01) |
| *F21V 23/02* | (2006.01) |
| *F21W 121/00* | (2006.01) |
| *F21Y 101/02* | (2006.01) |
| *F21Y 103/00* | (2006.01) |

(52) U.S. Cl.

CPC . *F21V 13/04* (2013.01); *F21V 5/04* (2013.01); *F21V 15/013* (2013.01); *F21V 33/0012* (2013.01); *A47B 2220/0077* (2013.01); *F21V 9/08* (2013.01); *F21V 13/14* (2013.01); *F21V 15/015* (2013.01); *F21V 23/023* (2013.01); *F21W 2121/00* (2013.01); *F21Y 2101/02* (2013.01); *F21Y 2103/00* (2013.01)

(58) Field of Classification Search

CPC ..... A47B 2220/0077; F21V 5/04; F21V 9/08; F21V 13/04; F21V 13/14; F21V 15/013; F21V 15/015; F21V 23/023; F21V 33/0012; F21Y 2101/02; F21Y 2103/00; F21W 2121/00

See application file for complete search history.

(56) References Cited

U.S. PATENT DOCUMENTS

2009/0161359 A1* 6/2009 Siemiet et al. ..... 362/235

* cited by examiner

*Primary Examiner* — Stephen F Husar
(74) *Attorney, Agent, or Firm* — Foley & Lardner LLP

(57) ABSTRACT

A lighting assembly is generally elongate having a base and a lens, which are configured to cooperatively define a cavity for receiving a light emitting device therein. The lens includes an inner layer and an outer layer, the inner layer being configured to diffuse light from the light emitting device passing through the lens and the outer layer being configured to change the hue of light passing through the lens. The outer layer and the inner layer are configured to provide the lens with four refractive surfaces for light passing through the lens.

15 Claims, 9 Drawing Sheets

LIGHTING ASSEMBLY

CROSS-REFERENCE TO RELATED PATENT APPLICATIONS

The present application claims priority to and the benefit of U.S. Provisional Patent Application No. 61/637,169, filed Apr. 23, 2012, the disclosure of which is incorporate herein by reference in its entirety.

BACKGROUND

The present disclosure relates generally to lighting. More particularly, the present disclosure relates to modular lighting assemblies.

SUMMARY

According to an exemplary embodiment, a lighting assembly is generally elongate having a base and a lens, which are configured to cooperatively define a cavity for receiving a light emitting device therein. The lens includes an inner layer and an outer layer, the inner layer being configured to diffuse light from the light emitting device passing through the lens and the outer layer being configured to change the hue of light passing through the lens. The outer layer and the inner layer are configured to provide the lens with four refractive surfaces for light passing through the lens.

According to an exemplary embodiment, a lighting assembly includes a base, a first light source coupled to the base, and an elongated lens. The elongated lens includes a U-shaped inner layer comprising a first material and a U-shaped outer layer comprising a second material. The first material is translucent but not transparent. The second material is transparent. The inner layer and the outer layer are separately formed and are coupled to each other.

According to an exemplary embodiment, a lighting assembly includes a base, a first elongated light source, and a second elongated light source. The first elongated light source is coupled to the base and has an associated elongated lens that is coupled to the base and positioned in front of the first light source. The second elongated light source is coupled to the base and is positioned below the first light source. The lighting assembly is configured to couple to a cabinet having a door with a forward surface, such that the second elongated light source is positioned rearward of the forward surface of the door. The base is configured to reflect light from the second light source downward and forward of the forward surface of the door.

DETAILED DESCRIPTION

Figure 1:
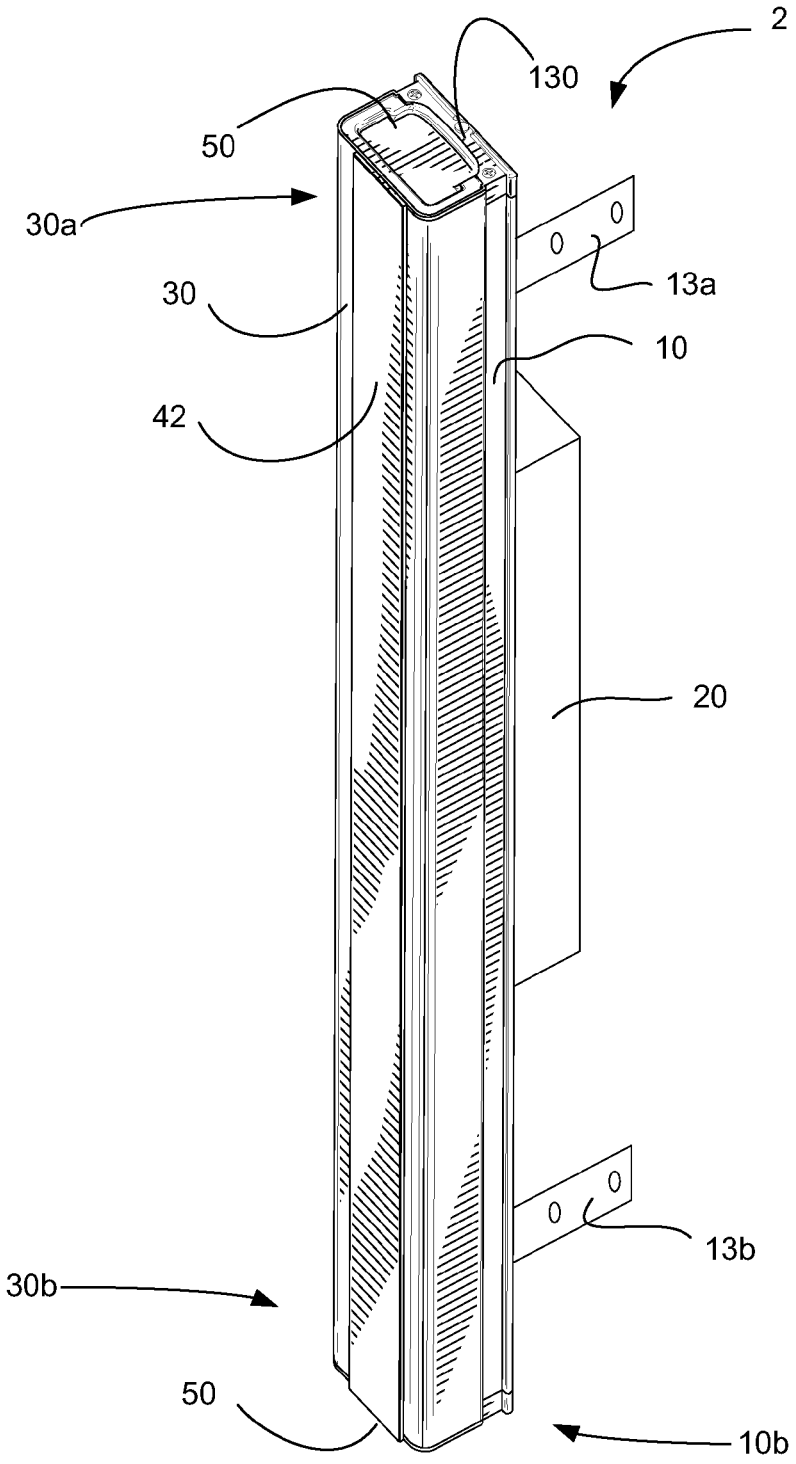
FIG. 1 is a perspective view of a lighting assembly according to an exemplary embodiment.
Figure 2:
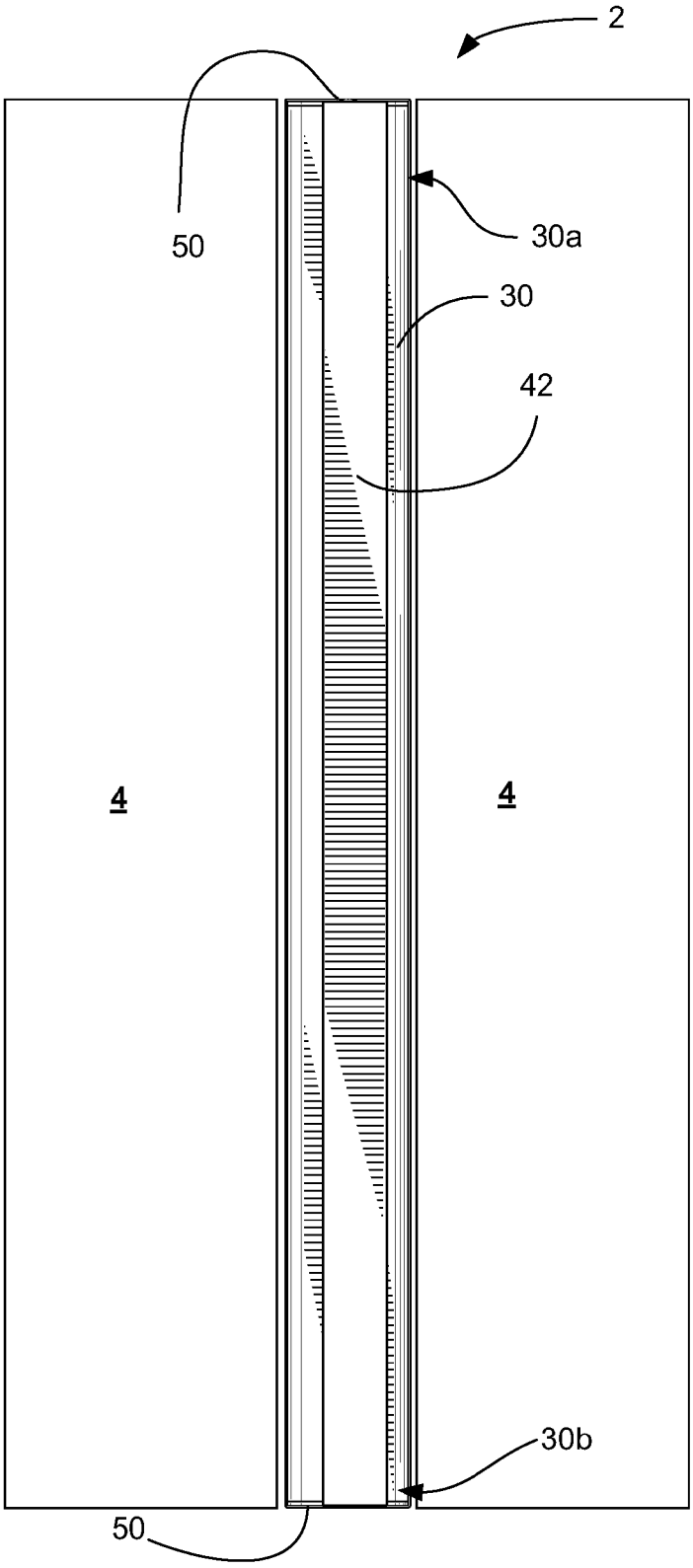
FIG. 2 is a front plan view of the lighting assembly of FIG. 1.
Figure 3:
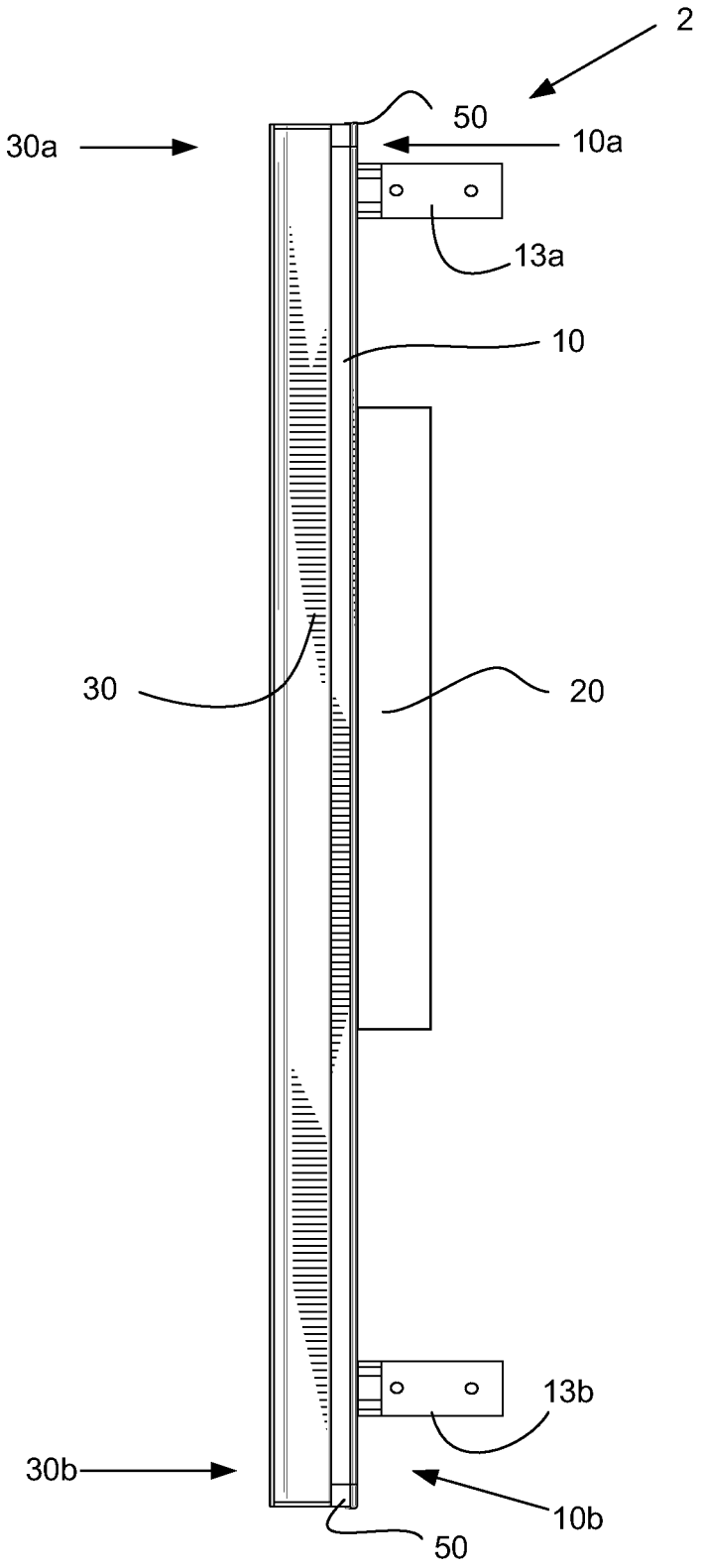
FIG. 3 is a side plan view of the lighting assembly of FIG. 1.
Figure 4:
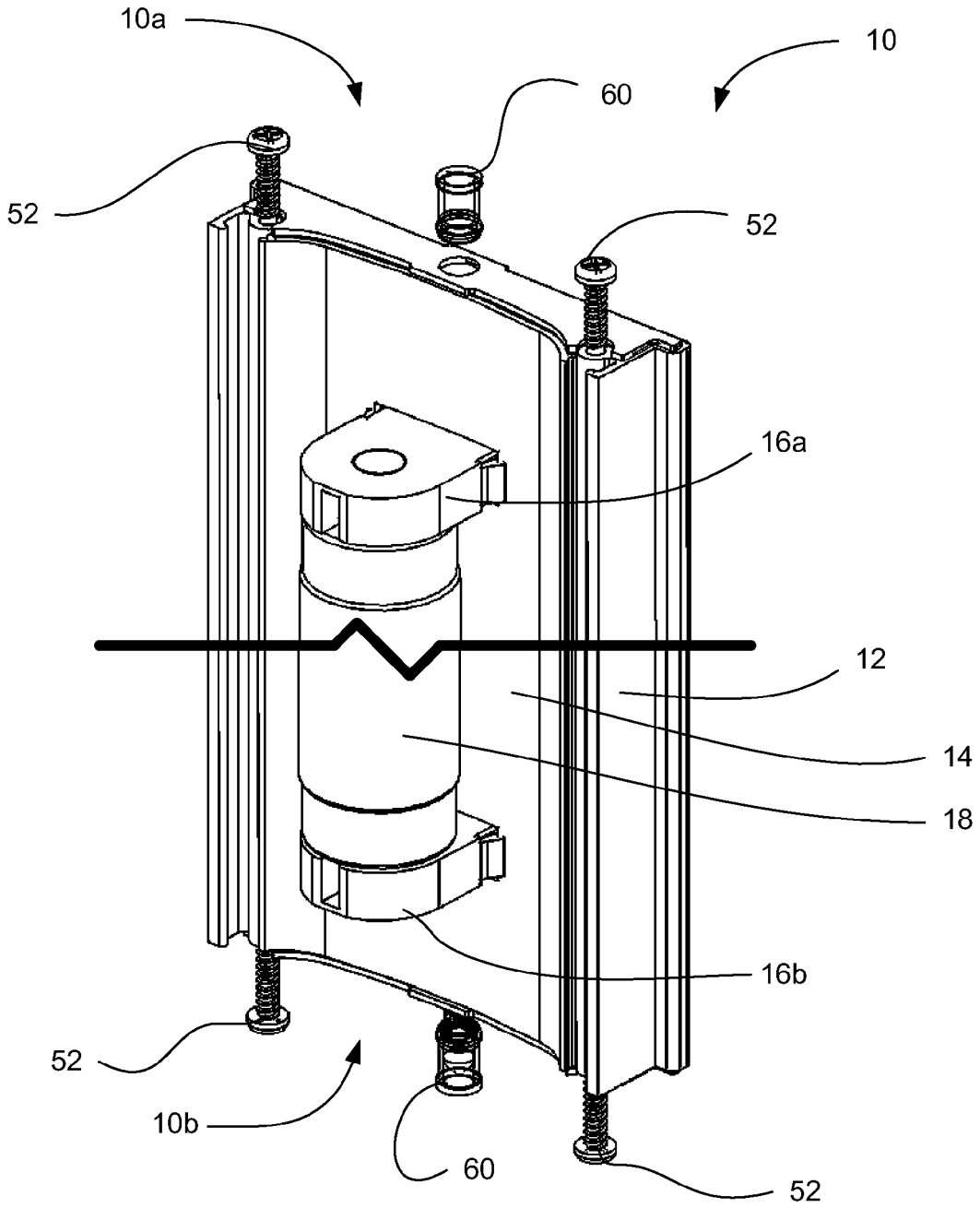
FIG. 4 is a perspective view of a partial lighting assembly according to an exemplary embodiment.
Figure 5:
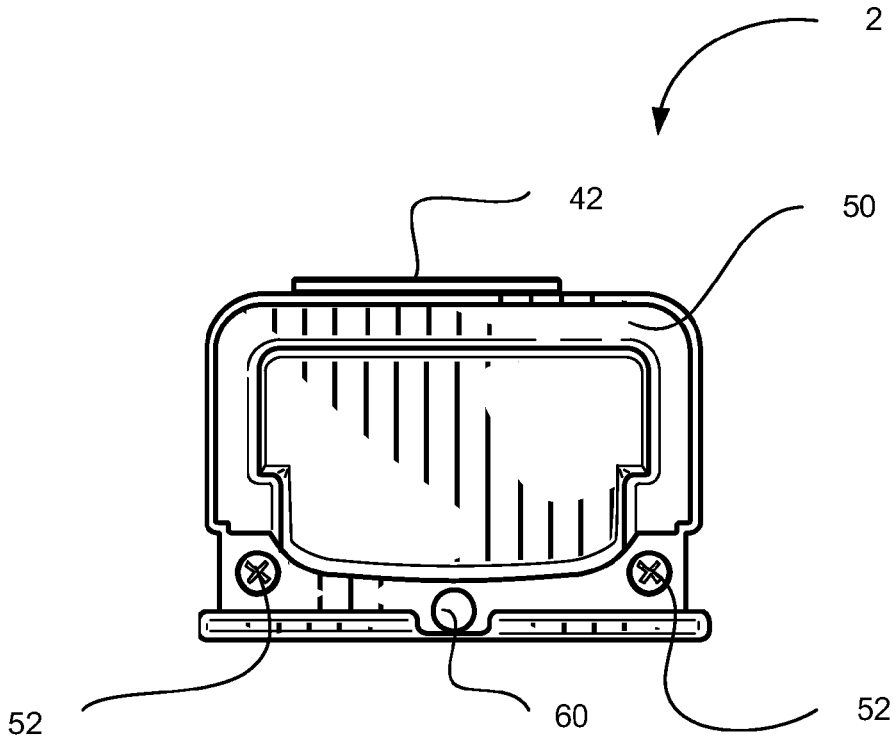
FIG. 5 is a partial perspective view of the lighting assembly of FIG. 1.
Figure 7:
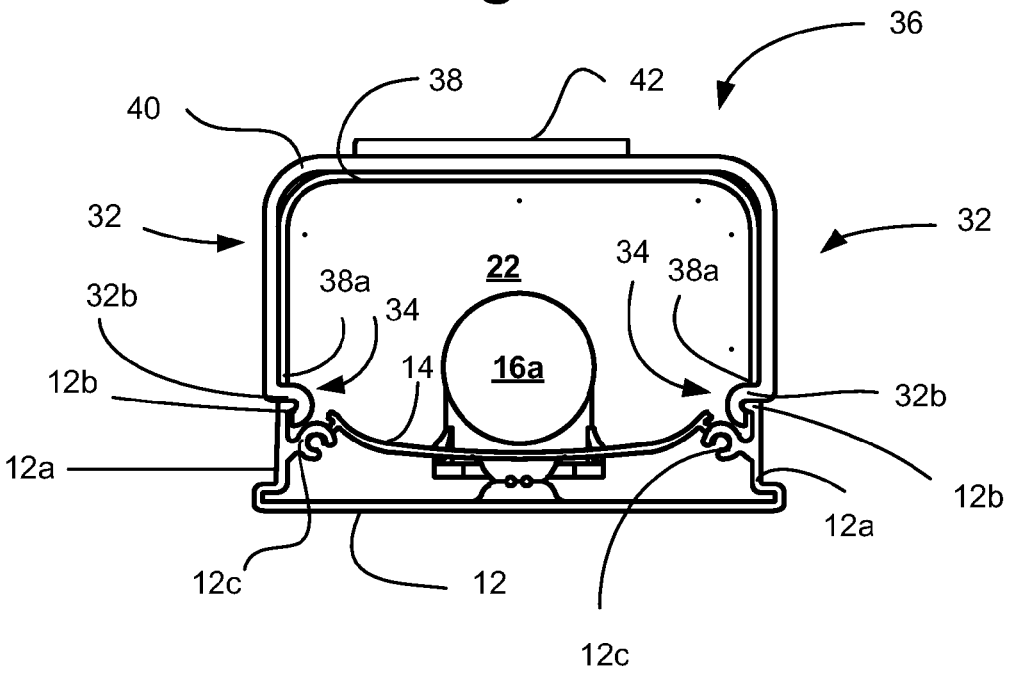
FIG. 7 is a top view of a partial lighting assembly according to an exemplary embodiment.
Figure 6:
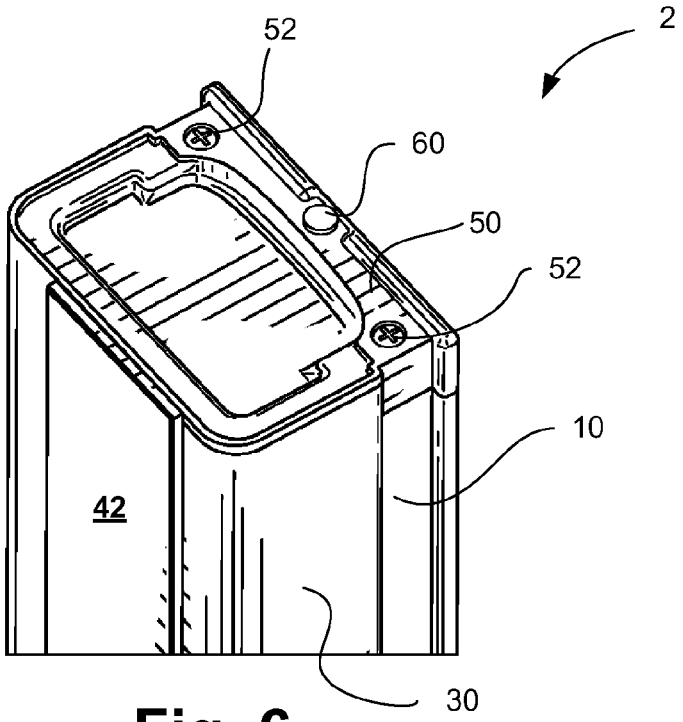
FIG. 6 is a top view of the lighting assembly of FIG. 1.
Figure 9:
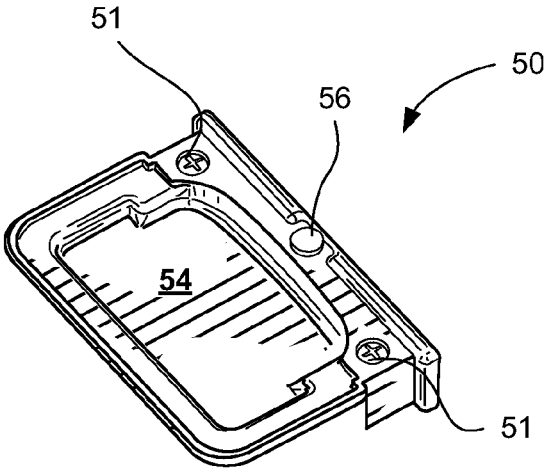
FIG. 9 is an upper perspective view of the component of FIG. 8.
Figure 8:
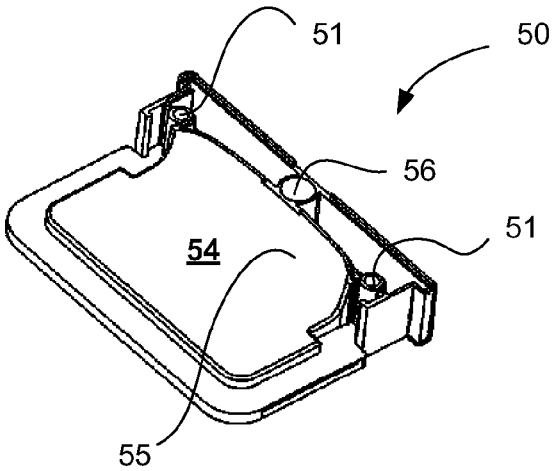
FIG. 8 is a lower perspective view of a component of a lighting assembly according to an exemplary embodiment.
Figure 10:
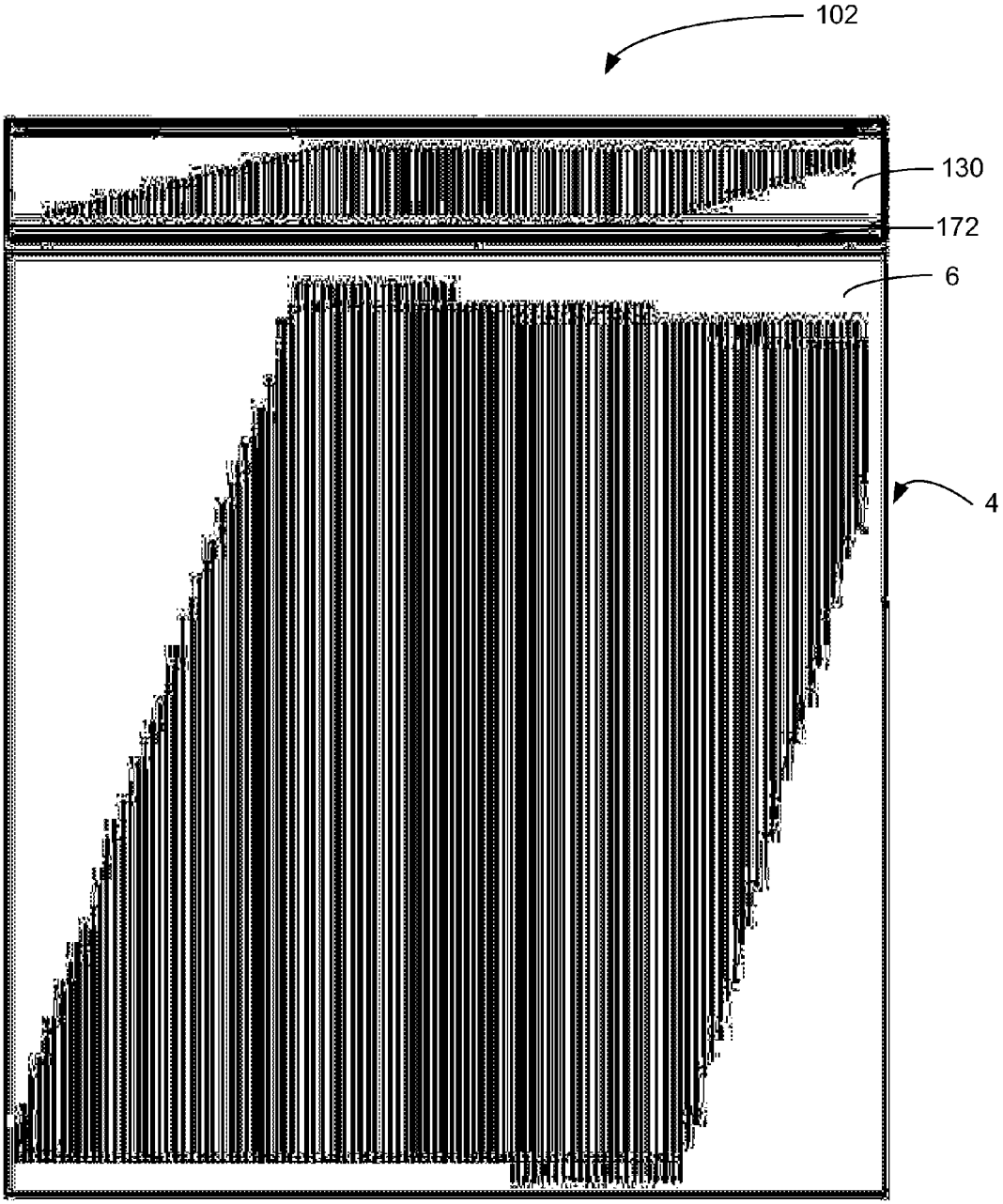
FIG. 10 is a front plan view of a lighting assembly and a medicine cabinet according to another exemplary embodiment.
Figure 11:
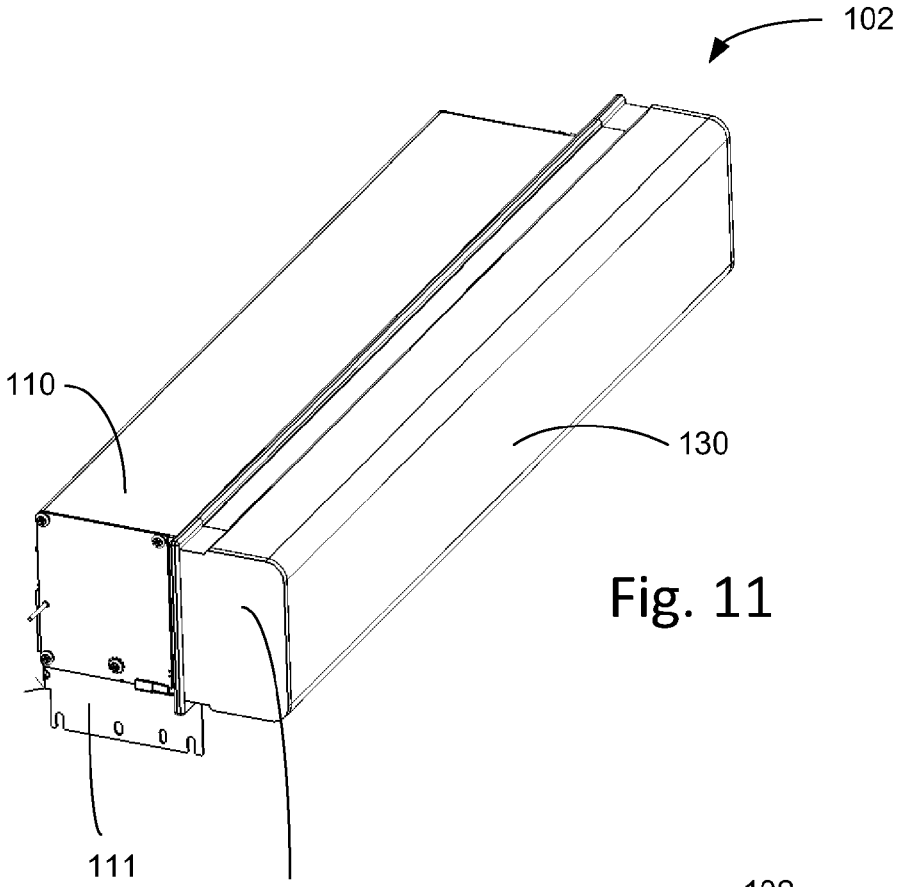
FIG. 11 is an upper perspective view of lighting assembly as shown in FIG. 10.
Figure 12:
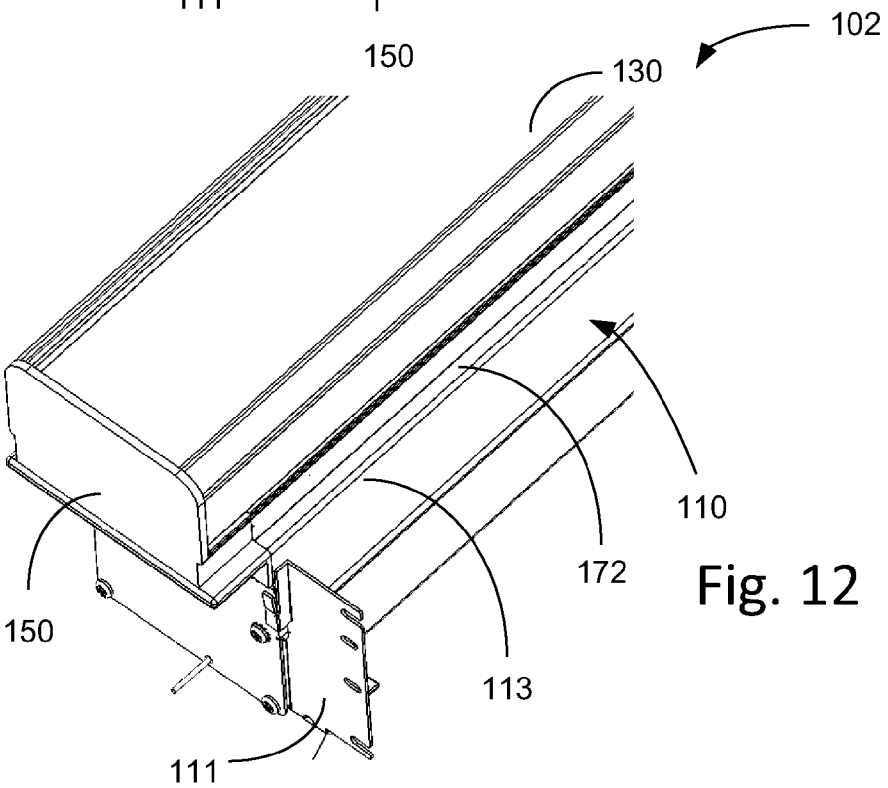
FIG. 12 is a partial, lower perspective view of the lighting assembly as shown in FIG. 10.

Referring generally to the Figures, according to an exemplary embodiment, a lighting assembly 2 generally includes a base 10 and a lens 30. The base 10 is generally configured to mount the lighting assembly 2 (e.g., to a wall or other surface) and includes components for holding and supplying electricity to one or more lamps, bulbs, or other types of light emitting devices. The lens 30 is generally configured to be positioned over the lamp, so as to diffuse or otherwise alter the appearance of light emitted from the lamp.

According to an exemplary embodiment, the base 10 generally includes a mounting plate or member 12, a reflector 14, and various electric components, such as first and second sockets 16*a*, 16*b* for supplying electricity to a lamp 18. The base 10, as referenced above, is generally configured for mounting the lighting device 2, as well as holding and supplying electricity to the lamp 18 and holding the lens 30 in position over the lamp 18.

According to an exemplary embodiment, the base 10 is generally elongated, extending between a first end 10*a* and a second end 10*b*. The base 10 may be sized according to various considerations including, for example, standard sizes for lamps 18 (e.g., linear fluorescent lamps, or other suitable light emitting device), size and shape of coordinating products (e.g., cabinetry 4), and other aesthetic considerations (e.g., desired visual mass). For example, lighting assembly 2 and base 10 may be configured to utilize standard 36" fluorescent linear lamps and be of similar size to cabinetry. Configured in this manner, the lighting assembly 2 and/or the base 10 may have a total length of between approximately 37" and 43", such as between approximately 39" and 41" (e.g., approximately 39⅜"). According to other exemplary embodiments, the lighting assembly may be different sizes (e.g. shorter or longer).

According to an exemplary embodiment, the mounting plate 12 is positioned at the rearmost portion of the base 10 and is configured to mount to a surface, such as a wall or cabinet. The mounting plate 12, for example, includes various apertures and/or brackets 13 configured to receive threaded fasteners (not shown) for screwing the base 10 to the mounting surface (e.g., a wall, wall studs, adjacent cabinetry, or other structural support). The mounting plate 12 may, for example, be a unitary extruded aluminum component. According to other exemplary embodiments, the mounting plate 12 may be configured in other manners including, for example, for using other mounting methods (e.g., adhesives, positive engagement features or tolerance fit with coordinating products, etc.), mounting to other structures (e.g., hanging from a single point, across two or more points of contact as opposed to a continual surface, and the like), using other manufacturing methods (e.g., molding, stamping, rolling, etc.), using other materials (e.g., steel or other metals, plastic or other polymer-based materials, composites, etc.), and the like.

According to an exemplary embodiment, the first and second sockets 16*a*, 16*b* are configured to receive ends of a fluorescent lamp 18 therein, so as to support the lamp 18. The sockets 16*a*, 16*b* are positioned generally proximate the first and second ends 10*a*, 10*b* of the base 10 and are equally spaced therefrom. The sockets 16*a*, 16*b* may, for example, be spaced apart a suitable distance from each other for receiving a conventional tubular fluorescent lamp 18 therebetween, such as a standard size linear fluorescent lamp (e.g., 36" or 24"), or may be spaced apart any other suitable distance (e.g., for non-standard sizes of lamps). According to other exemplary embodiments, the sockets 16*a*, 16*b* may be configured in other manners including, for example, by providing additional sockets (e.g., for multiple bulbs mounted parallel to each other), providing a third socket in an intermediate position for mounting bulbs in series, etc.), placing the sockets in different locations (e.g., different spacing relative to the ends 10*a*, 10*b* of the base 10, etc.), and the like.

According to an exemplary embodiment, the sockets 16*a*, 16*b* are configured to supply electricity to the lamp 18. For example, the sockets 16*a*, 16*b* are electrically connected to a power supply 20 (e.g., a ballast) that is wired or otherwise connected to an electricity source (e.g., a home's wiring system) and is configured to provide a steady current and sufficient voltage for the fluorescent lamp 18 to operate. Electricity is selectively supplied to the power supply or other electronics 20 and, hence, to the lamp 18 by way of a switch (not shown) that is manually operated. The power supply 20 may also positioned behind the mounting plate 12 (so as to be hidden from view) and may also be configured to supply electricity to another lighting assembly 2 (i.e., one power supply may supply electricity to multiple lighting assemblies 2 and multiple lamps 18). According to other exemplary embodiments, the sockets 16*a*, 16*b* may be configured in other manners including, for example, by being supplied by a remotely positioned power supply (e.g., positioned on another lighting assembly 2 or as an independent device), being selectively operated in another manner (e.g., timer, motion sensor, ambient light sensor, and the like in combination with each other and/or a manually operated switch), and other manners as recognized by those skilled in the art.

According to other exemplary embodiments, the lighting assembly 2 may be configured with a different type of light emitting device. For example, the lighting assembly 2 may include a series of light emitting diodes (i.e., LEDs) that are distributed evenly along the length of the lighting assembly between the first end 10*a* and second end 10*b* of the base 10. By using a series of LEDs, the illusion of a single light source may still be achieved (i.e., similar to a linear fluorescent lamp), while offering other advantages. For example, LEDs may offer longer life, lower energy usage, and lower heat output than fluorescent lamps. Furthermore, a series of LEDs may allow more even light distribution throughout the entire length of the light assembly (i.e., closer to the ends 10*a*, 10*b* of the base 10), whereas lighting assemblies using linear fluorescent lamps may have dark regions in areas extending beyond the ends of a standard size lamp. In lighting assemblies utilizing LEDs, appropriate electronic components are used (i.e., an appropriately configured power supply and suitable connectors), such as for connecting to the LEDs and for supplying electricity in an appropriate form (i.e., current type and voltage level). Selective operation of the LEDs may be provided as described above with respect to fluorescent lamps (e.g., manual switch, timer, motion sensor, light sensor, combinations thereof, etc.).

According to an exemplary embodiment, the reflector 14 is coupled to the mounting plate 12 so as to be between the lamp 18 and the mounting plate 12. The reflector 14 is configured to reflect light emitted from the lamp 18 away from the base 10 (i.e., outward from the lighting fixture 2). For example, the reflector 14 may be a unitary stamped steel component having a polished surface and a suitable curvature to reflect light emitted from the lamp 18 forward and outward from the lighting assembly 2. According to other exemplary embodiments, the reflector 14 may be configured in other manners including, for example, by being multiple pieces, using different manufacturing methods (e.g., extruding, etc.), using different materials (e.g., aluminum or other metals, suitable plastics or composites, etc.), using other reflecting means (e.g., a chromed finishe), and the like.

According to an exemplary embodiment, the lens 30 is configured to alter the visual characteristics of light emitted from the lamp 18 or other light emitting device. The lens 30 is configured to couple to the base 10 so as to define a cavity 22 in which the lamp 18 is positioned. Light emitted from the lamp 18 or other light emitting device then passes through the lens 30, so as to be altered in appearance before reaching the user. The lens 30 is generally U-shaped having generally flat side portions 32 that extend from edges 34 to a flat face or end 36, so as to define generally three-sides of the cavity 22 and to generally surround the lamp 18. According to other exemplary embodiments, the lens 30 may be configured in other manners including, for example, by having one or more side portions 32 shaped differently (e.g., curved, irregular, or otherwise varied cross-section), having the face 36 shaped differently (e.g., curved, irregular, or otherwise varied cross section), by defining fewer than three full sides of the cavity 22 (e.g., by defining only the face 36, only one of the side portions 32, or only part of the side portions 32 of the cavity 22).

According to an exemplary embodiment, the lens 30 and the base 10 have cooperative lengths. For example, the lens 30 and the base 10 may have substantially the same length, such that the lens 30 extends between a first end 30*a* and second end 30*b* substantially the entire distance between the first and second ends 10*a*, 10*b* of the base 10. According to another exemplary embodiment, the lens 30 is longer than the base 10, such that an end plate 50 (e.g., cap, cover, etc. as discussed in further detail below) may be received partially behind the lens 30 to couple to and/or abut the lens 30 and the base 10. According to other exemplary embodiments, the lens 30 may have a different length relative to the base 10 (e.g., longer or shorter).

According to an exemplary embodiment, the lens 30 and the base 10 have cooperative widths. For example, the lens 30 may have substantially the same width or be wide than the base 10 so as to hid the base 10 from view.

Further, lens 30 and the base 10 are cooperatively configured for the lens 30 to mount to the base 10. The mounting plate 12 of the base 10 includes outward extending projections 12*a* that partially define the sides of the cavity 22 and which define the outermost portions of the base 10. Each projection 12*a* includes an inwardly-directed male form or member 12*b* (e.g., a projection). The lens 30 is cooperatively configured with the edges 32 each having an outwardly facing female form or member 32*b* (e.g., a recess or C-shaped portion) that is configured to receive one of the male forms 12*b* of the mounting plate 12 therein. Configured in this manner (i.e., such that the male forms 12*b* of the mounting plate 12 are received within the female form 32*b* of the lens 30), the lens 30 may be mounted or coupled to the base 10. According to other exemplary embodiments, the lens 30 and base 10 may be configured in other manners for coupling therebetween including, for example, switching placement of the male and female forms (i.e., providing the male form on the lens 30 and the female form on the mounting plate 12), changing orientation of the male and female forms (i.e., having the male form 12*b* of the mounting place face outward, and the female form 32*b* face inward), and the like. According to other exemplary embodiments, the lens 30 is configured to mount to the base 10 in other manners including, for example, by using adhesives, fasteners, or other features, alone or in combination with each other and/or the male and female forms 12*b*, 32*b*.

According to an exemplary embodiment, the edges 32 of the lens 30 are configured to be received between the projections 12*a* of the mounting plate 12, such that the lens 30 is held in compression by the mounting plate 12. For example, the lens 30 may be configured to be slightly wider than the mounting plate 12. That is, when the lens 30 and mounting plate 12*b* are in a relaxed state, the distance between the portions of the female forms 32*b* of the lens 30 that directly contact the male forms 12*b* of the mounting plate 12 is slightly greater than the distance between the portions of the male forms 12*b* that directly engage the female forms 32*b*. Elasticity and/or stiffness of the material forming the lens 30 (discussed in further detail below) is configured to allow the lens 30 to be inserted radially between the projections 12*a* of the mounting plate 12 (i.e., the edges 32 are pushed closer to each other) and for the lens 30 to be retained between the projections 12*a* (i.e., the spring force of the lens 30 pushes outward against the projections 12*a*, so as to increase friction between the lens 30 and the mounting plate 12). According to other exemplary embodiments, the mounting plate 12 and, in particular, its projections 12*a* may instead or additionally, be configured with appropriate elasticity and stiffness for retaining the lens 30 therein. According to still other exemplary embodiments, the lens 30 may be configured to be inserted between the projections 12*a* of the mounting plate from one of the ends 10*a*, 10*b* of the base 10 (i.e., to be slid into position). According to those embodiments wherein the projections 12*a* are received between the edges 32 of the lens 30, the lens 30 is instead configured to be held in tension (i.e., the edges 32 of lens 30 press inward against projections 12*a* of the mounting plate 12).

According to an exemplary embodiment, the lens 30 includes extruded acrylic material. More particularly, the lens 30 includes a first or inner layer 38 and a second or outer layer 40 of extruded acrylic material, the inner layer 38 and the second outer layer 40 having different transparency, translucency, and/or color properties.

According to an exemplary embodiment, the inner layer 38 of the lens 30 is configured to diffuse light emitted from the lamp 18 or other light emitting source, so as to balance aesthetic properties of light emittance (i.e., maximize the transfer of light through the lens) and show through (i.e., hide or disguise the various components of the lighting assembly 2 behind the lens 30). For example, the inner layer 38 of the lens 30 may be a unitary, extruded, white, translucent acrylic material that is between approximately 1/32 of an inch and 1/4 of an inch thick (e.g., approximately 1/16th inch). According to other exemplary embodiments, the inner layer 38 may be configured in other manners including, for example, by comprising multiple components, being formed in different manners (e.g., molding, blowing, etc.), being different colors, having different opacity or transparency, being a different material (e.g., polycarbonate, etc.), having a surface finish (e.g., matte, polished or glossy, etc.), and the like.

According to an exemplary embodiment, the outer layer 40 of the lens 30 is configured to provide a color or hue to the light emitted from the lamp or other light emitting source. For example, the outer layer 40 of the lens 30 may be a unitary, extruded, transparent acrylic material having a green hue (e.g., "Coke-bottle green") that is between approximately 1/32 of inch and 1/4 of an inch thick (e.g., approximately 1/8th inch). According to other exemplary embodiments, the outer layer 40 may be configured in other manners including, for example, by comprising multiple components, being formed in different manners (e.g., molding, blowing, etc.), being different colors, having different opacity or translucency, being a different material (e.g., polycarbonate, etc.), having a surface finish (e.g., matte, polished or glossy, etc.), and the like.

According to an exemplary embodiment, the inner layer 38 and the outer layer 40 of the lens are extruded as separate components that are subsequently layered or placed adjacent each other. Advantageously, by providing the inner layer 38 and the outer layer 40 as separate layers (i.e., as opposed to co-extruding the inner and outer layers 38, 40 together), the lens 30 is configured with four refractive surfaces (i.e., inner and outer surfaces of both the inner layer 38 and the outer layer 40) providing different aesthetics as compared to a unitary lens. For example, configured as described above (i.e., white, translucent inner layer 38 and green-hued, transparent outer layer 40), the lens 30 has the general appearance of back-painted glass. According to other exemplary embodiment, the lens 30 may be configured in other manners with different combinations of parameters as discussed above for the inner and outer layers 38, 40 (e.g., manufacturing method, color, translucency/transparency, material, surface finished, etc.).

According to an exemplary embodiment, the inner layer 38 and the outer layer 40 of the lens are coupled together. More particularly, both the inner layer 38 and the outer layer 40 are generally U-shaped, the inner layer 38 being sized, shaped, and otherwise configured to be received within the outer layer 40, such that the outer surface of the inner layer 38 is positioned proximate to or directly adjacent the inner surface of the outer layer 40. For example, outer side surfaces of the inner layer 38 may engage inner surfaces of the outer layer 40, and an outer forward surface of the inner layer 38 may engage an inner forward surface of the outer layer 40. In corner regions or intersection between the forward surface 36 and sides 34, there may be a gap between the inner and outer layers 38, 40, or there may be no gap. Edges 38*a* of the inner layer 38 are configured to generally abut against the female form 32*b*, such that the inner layer 38 is held within the outer layer 40 for coupling the inner layer 38 to the outer layer 40. Instead, or additionally, the inner layer 38 may be coupled to the outer layer 40 by way of a friction or tolerance fit, for example, such that the inner layer 38 is compressed between the sides of the outer layer 40. According to other exemplary embodiments, the inner layer 38 and the outer layer 40 may be coupled to each other in other manners include, for example, with adhesives, fasteners, complementary positive engagements features, and the like, alone or in combination with each other and the other methods described previously.

According to an exemplary embodiment, the lens further includes a decorative layer 42. The decorative layer 42 is configured to further improve the aesthetic of the lighting assembly. For example, the decorative layer 42 is generally positioned on the outer face 36 of the lens 30, the outer face 36 being coupled to the lens 30 by way of an adhesive tape. The decorative layer 42 is an opaque, elongate member that prevents passage of light therethrough to, for example, have a softening effect on light emitted from the lighting assembly 2. The decorative layer 42 may also be configured to have a complementary appearance to coordinated products (e.g., cabinetry 4 positioned adjacent the lighting assembly 2). For example, the decorative layer 42 may be a mirror or otherwise have a mirrored surface. According to other exemplary embodiments, the decorative layer 42 is configured other manners including, for example, by being positioned and/or shaped differently, being transparent or translucent, having a color, etc.

According to an exemplary embodiment, the lighting assembly includes an end plate or cover 50 that is configured to enclose the cavity 22 defined by the base 10 and the lens 30. The end plate 50 has an outer shape or profile that is complementary to the lens 30 (i.e., to the shape of the outer surface of the outer layer 40) and the base 10 (i.e., to the outer surface of the projections 12*a* of the mounting plate 12). One end plate 50 is configured to be coupled to the base 10 at each of the first end 10*a* and the second end 10*b* thereof. For example, the each cover 50 includes one or more fastener apertures 51 that are configured to receive a threaded fastener 52 therethrough, which engages the mounting plate 12. More particularly, the mounting plate 12 defines a channels 12*c* that are positioned inward from each of the protrusions 12*a*. The channels 12*c* are configured to receive the fastener 52 therein so as to positively couple the end plate 50 to the mounting plate 12. Configured in this manner, the end plate or cover 50 may provide an aesthetically pleasing appearance by closing the cavity 22 and may, instead or additionally, function to prevent sliding of the lens 30 relative to the base 10 (e.g., if the lighting assembly 2 is mounted vertically and gravity forces the lens 30 downward relative to the base 10). According to other exemplary embodiments, the end plate 50 is configured in other manners including, for example, by having a different shape or profile than the base 10 and the lens 30, coupling to the mounting plate 12 in different manners (e.g., adhesives, press- or tolerance fit, integrally formed positive engagement features such as clips or tabs, other fasteners such as sprung clips, and the like, alone or in combination with each other and/or threaded fasteners), use of a different number of fasteners (e.g., more or less than two), and the like.

According to an exemplary embodiment, the end plate 50 is configured to enhance the aesthetic appearance of light transmitted from the lamp 18. More particularly, the end plate 50 is configured hide or mask a light gap (if present) between each end of the lamp 18 and the ends 10*a*, 10*b* of the base and 30*a*, 30*b* of the lens. That is, the lamp 18 may not extended the entire distance between each end of the lighting assembly 2, such that end portions of the lighting assembly 2 or the lens 30 (i.e., first and second ends 30*a*, 30*b*) may appear darker or unlit. The end plate 50 is configured to reflect and/or refract light emitted by the lamp or other light emitting device to better distribute and transmit light through lens 30 proximate the first and second ends 30*a*, 30*b* thereof.

More particularly, the end plate 50 comprises a translucent or transparent material and a projection 54 that is positioned at least partially within the cavity 22 defined by the lens 30 and the base 10. Viewed from outside the cavity 22, the projection 54 may appear as a recess extending into the cavity 22. Configured in this manner, light emitted by the lamp 18 or other device and reflected within the cavity 22 passes through the translucent material of the end plate 50 so as to illuminate end regions of the lighting assembly 2. The projection 54 may further include a curved portion defining a rearwardly and inwardly sloping, forward facing concave surface 55. Instead, or additionally, the end plate 50 may also be configured to reflect light through the lens 30 proximate its ends 30*a*, 30*b*, so as to illuminate portions of the lens 30 that might otherwise appear dark.

According to an exemplary embodiment, the end plate 50 is a unitary, injection molded, clear, polycarbonate component having a surface texture (e.g., pebbled) formed thereon, so as to diffuse the light therethrough (e.g., to provide a soft light, and prevent show-through or conceal components of the lighting assembly 2 within the cavity 22). According to other exemplary embodiments, the end plate 50 may be configured in other manners including, for example, by being comprising multiple components, using different manufacturing methods (e.g., stamping, compression molding, etc.), using different colors, using different materials (e.g., acrylic, glass, etc.), provide a different surface texture (e.g., gloss, geometric pattern, other pattern, etc.), and the like, alone or in combination, as may be desired for aesthetic or functional reasons as recognized by those skilled in the art.

According to an exemplary embodiment, the lighting assembly 2 includes a secondary light or night light 60. The secondary or second light 60 is configured to illuminate end portions of the lighting assembly (e.g., the end plate 50). For example, the second light 60 may be an LED generally positioned within a light aperture or recess 56 of the end plate 50 at a lower end of the light assembly 2. The second light 60 may, for example, be a standard type LED having a remotely positioned power supply or transformer. The second light 60 may, for example, be operated by a manual switch independent of operation of the lamp 18. According to other exemplary embodiments, the second light may be configured in other manners including, for example, being provided in different positions (e.g., along sides of the lighting assembly 2, adjacent the end plate 50, entirely within the cavity 22, entirely outside the cavity 22, etc.), being a different type (e.g., provided on a printed circuit board that includes a transformer or other necessary circuitry), being operated in different manners (e.g., timer, motion sensor, ambient light sensor, alone or in conjunction with the lamp 18, and the like in combination with each other and/or a manually operated switch), and the like. Applicants note that by arranging the transformer (not shown) remotely from the LED and outside the cavity 22 (e.g., being the mounting plate 12), a wider selection of materials may be used for the end plate while still complying with various testing and safety standards (e.g., UL).

As shown in FIGS. 10-15, according to another exemplary embodiment, a lighting assembly 102 generally includes a base or housing 110, a light source (e.g., lamp 118), and a lens 130. The lighting assembly 102 is configured to be mounted above a cabinet 4 (e.g., medicine cabinet). The lens 130 is configured to be positioned substantially (e.g., entirely) forward of a door 6 of the medicine cabinet 4 (i.e., substantially or entirely between a user and the cabinet 4). The lighting assembly 102 may further include a secondary lighting source 170 configured to shine light downward in front of the door 6 when closed and/or into a cavity of the cabinet 4 when the door 6 is open.

According to an exemplary embodiment, the housing 110 is configured to mount the lighting assembly 102 to the cabinet 4 and/or to another structure (e.g., a wall, stud, or other structure of a home or building). For example, the housing 110 may include flanges 111 that mount to outer walls of the cabinet 4 with threaded fasteners. The housing 112, as well as the entire lighting assembly 102, may be sized according to width of the cabinet 4, for example, having with that is approximately 16 inches, 20 inches, 24 inches, or any other suitable dimension. The lighting assembly 102 may further be mounted, such that the housing 110 is generally recessed into a wall structure of a building (e.g., if the cabinet 4 is also recessed) with the lens 130 extending forward thererfrom (e.g., being positioned forward of the wall).

Figure 13:
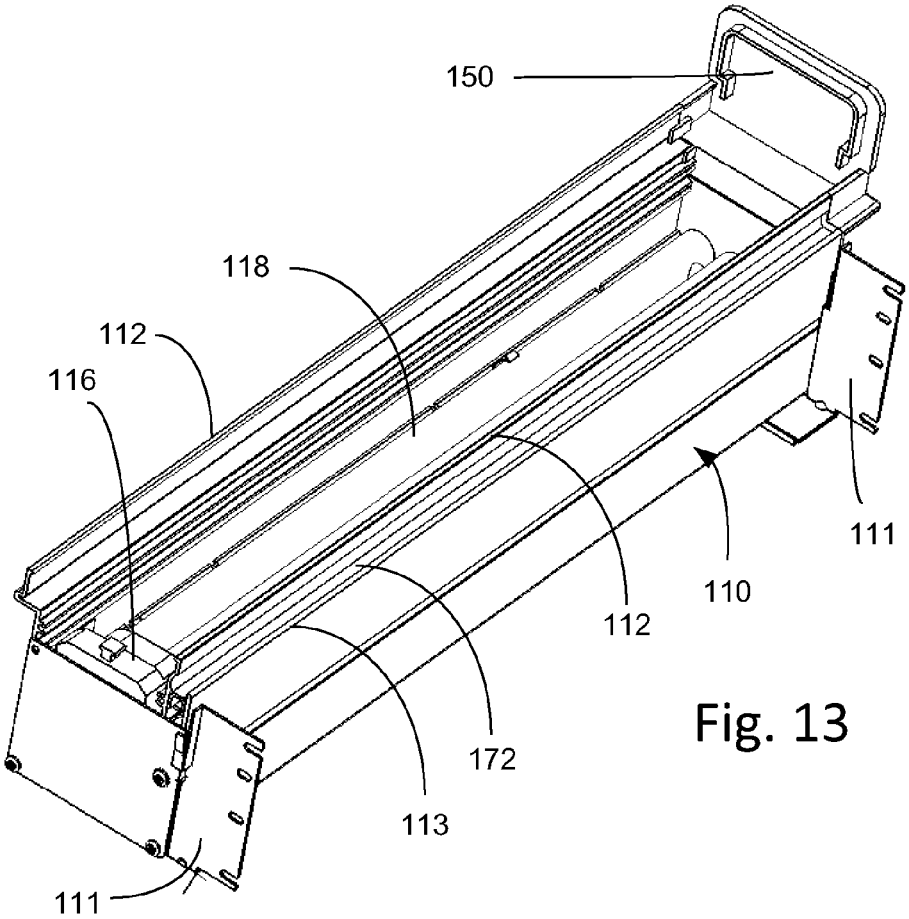
FIG. 13 is a partial, lower perspective view of the lighting assembly as shown in FIG. 10.
Figure 14:
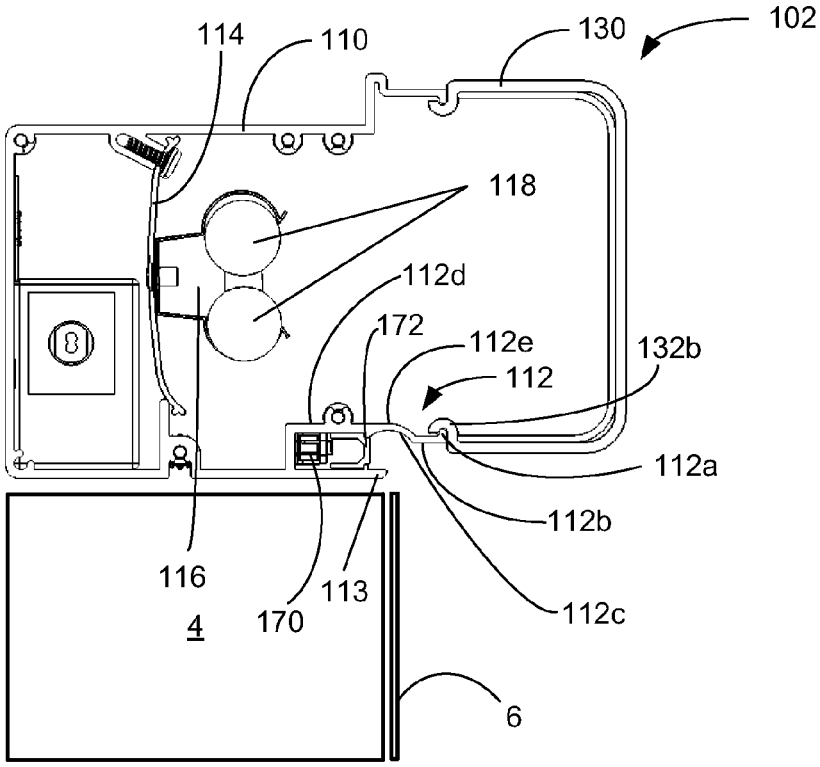
FIG. 14 is a cross-sectional view of the lighting assembly and medicine cabinet taken along line 14-14 in FIG. 10.

As shown in FIGS. 13 and 14, according to an exemplary embodiment, the housing 110 is configured as a chassis or structure for supporting and/or containing various components of the lighting assembly 102. A reflector 114, electrical connectors 116 (e.g., sockets), and the one or more light sources 118 (e.g., lamps or bulbs) are positioned in the cavity or channel of the housing 110, such that the housing 110 substantially surrounds each of the lamps 118. The reflector 114 may be configured substantially similar to reflector 14 described previously (e.g., materials, surface finish, curvature, etc.). The reflector 114 is positioned rearward or behind the lamps 118 and is configured to reflect light emanating from the maps in a forward direction. The sockets 116 may be configured for a twin-tube compact fluorescent bulb 118 (e.g., 2G11 base), or any other suitable bulb or lamp. The electrical connectors 116 may, for example, be wired to a building's electrical system and be operated by a conventional wall-mounted light switch.

According to an exemplary embodiment, the lens 130 is configured substantially similar to that of the lens 30 (e.g., having interfitting U-shaped inner and outer layers 138, 140 with similar materials, manufacturing processes, etc.). The lens 130 is mounted to the housing 110 forward of the cavity or channel defined therein. As such, the lens 130 is mounted substantially (e.g., entirely) forward of the light source 118, such that the light source 118 is not positioned in the cavity defined by the U-shape of the lens 130 (i.e., in contrast to the lens 30 which surrounds at least a portion of the lamp 18). By positioning the light source 118 rearward of and outside the cavity of the lens 130, shadows and/or dark spots may be minimized in the lens 130 to provide even light emanating from the lens 130.

Referring to FIG. 14, according to an exemplary embodiment, the housing or base 110 and lens 130 are configured to couple to each other in a substantially similar manner as that for base 10 and lens 30 as described previously. The flanges 112 of the base 110 include forward portions 112*a* (e.g., projections, extensions, etc.), each having an inwardly projecting or opposing male form or member 112*b* that is configured to be received within the female form or member 132*b* defined by an inwardly protruding flange of the lens 130.

According to an exemplary embodiment, the lighting assembly 110 includes an end cap or cover 150 disposed on each side of the lens 130, so as to enclose the cavity defined by the U-shaped lens 130. The end cap 150 includes a generally planar outer surface 151. The end cap 150 may be configured with the similar materials, surface finish and manufacturing process as described for the end plate 50. The end cap 150 may, for example, be coupled to the housing 110 with out the use of visible fasteners (e.g., with a press or tolerance fit between the housing 110 and end cap 150, use of integrally or separately formed positive engagement features such as tabs, hooks, recesses, apertures, etc.). According to other exemplary embodiments, fasteners, adhesives, or any other suitable method.

According to an exemplary embodiment, the lighting assembly 110 includes a secondary light source 170. The secondary light source 170 is configured to project light in a downward and/or forward direction in front of the door 6 of the cabinet 4.

According to an exemplary embodiment, the base 110 defines a forward facing channel or cavity in which the secondary light source 170 (e.g., one or more LEDs) is positioned. The channel is positioned at a bottom portion of the base 110. For example, the channel is positioned generally below and forward of the light sources 118 and/or rearward of the lens 130. The channel is defined between a rearward portion 112*d* of a lower of the flanges 112 (i.e., rearward of the forward extensions 112*a* to which the lens 130 is coupled) and a lower flange 113 positioned below the flange 112. The rearward portion 112*d* of the flange 112*a* defining the channel may, for example, extend generally horizontal in a forward direction. The lower flange 113 may extend forward parallel to the rearward portion 112*d* of the flange 112*a* defining the channel and terminate prior to the end of the flange 112*a* (e.g., rearward of protrusion 112*b* and the lens 130). The terminating end of the lower flange 113 may further be positioned generally rearward of a forward surface of the door 6 and/or generally coextensive with a forward opening of the cabinet 4.

According to an exemplary embodiment, a lens or diffuser 172 is positioned in the channel forward of the light source 118. The lens 172 is configured to diffuse light emanating from the individual lights sources 170 (e.g., spaced apart LEDs forming an elongated light source) to minimize the appearance of localized light sources, so as to provide the appearance of a generally continuous light source. The lens 172 includes a forward, generally vertical surface through which light emanates. The forward surface of the lens 172 is positioned rearward of the terminating end of the lower flange 113, such that that forward surface of the lens 172 is recessed into the channel. The forward surface of the lens 172 is further positioned rearward of the forward opening of the cabinet 4 and rearward of a rearward surface of the door 6. Configured in this manner, the lens 172 and light source 170 are recessed relative to the forward opening of cabinet 4 and relative to the forward and rearward surfaces of the door 6 (when pivoted closed). According to other exemplary embodiments, the forward surface of the lens 172 may be coextensive with the terminating end of the flange 113 and/or the forward opening of the cabinet 4 or the rearward surface of the door 6.

According to an exemplary embodiment, the lens 172 has a U-shaped cross-section having legs extending rearward of the forward surface, which engage inner surfaces the rearward portion 112*d* of the flange 112 and the lower flange 113. One or more of the flange 112 and the lower flange 113 may further include inwardly extending projections (e.g., members, protrusions, etc.) configured to retain the lens 172 in the channel after insertion therein. The lens 172 may, for example, be an extruded, translucent polymer material (e.g., similar to the inner or outer layers 138, 140 of the lens 130, or to the end caps 150). According to other exemplary embodiments, the lens 172 may be made from any other suitable material or manufacturing methods. According to still further embodiments, the lighting assembly 102 does not include a lens for the second light source 170.

According to an exemplary embodiment, the flange 112 of the base 110 is configured as a reflector to direct light emanating from the light sources 172 in a downward and forward direction. For example, the flange 112 includes an intermediate portion 112*e* extending generally between the rearward portion 112*d* (i.e., defining the upper bounds of the channel) and the forward portion 112*a* (i.e., to which the lens 130 is coupled). The intermediate portion 112*e* has a concave curvature or surface 112*c* extending, at least in part, forward and downward, so as to reflect light emanating from the light sources 172 in a downward direction. According to other exemplary embodiments, the concave reflective surface may be provided separate from the base 110 (e.g., being coupled to the flange 112 or other portion of the base 110).

For example, light originates from the light sources 170 positioned in a rearward portion of the channel and is transmitted through the generally vertical forward surface of the lens 172. The concave surface 112*c* of the intermediate portion 112*e* of the flange 112 is positioned substantially (e.g., entirely) forward of the lens 172 and may also be positioned at least partially forward of the terminating end of the flange 113. The concave surface 112*c* of the intermediate portion 112*e* may also be positioned partially below an upper end of the forward surface of the lens 172 (or the rearward portion 112*d* of the flange, or upper portion of the channel) to reflect light downward.

According to an exemplary embodiment, a portion of the concave surface 112*c* of the intermediate portion 112*e* is spaced above the forward surface of the door 6 of the cabinet 4. For example, the concave surface 112*c* may extend forward of the door 6 (as shown in FIG. 14), or may terminate rearward of the forward surface of the door (e.g., for a thicker door, not shown). Configured in this manner, the light reflected downward by the intermediate portion 112*e* of the flange 112 may be cast downward and forward of the forward surface of the door 6. Still further, configured in this manner, the second light source 170, provides recessed and/or generally hidden lighting (i.e., rearward of the lens 130, the door 6, and/or the opening of the cabinet 4) that may softly illuminate a room in which the lighting assembly 100 is placed.

According to an exemplary embodiment, the concave surface 112*c* of the intermediate portion 112*e* is positioned at least partially forward of the opening of the cabinet 4, such that when the door 6 is pivoted open, light reflected downward by the intermediate portion 112*e* of the flange 112 enters the cavity of the cabinet 4 (e.g., for illuminating the contents of the cabinet 4). More particularly, a rear surface of the door 6 may also be reflective (e.g., mirrored, polished, glossy, etc.) such that when the door 6 is open, light from the light sources 170 may reflect rearward off the rear surface of the door 6 into the cavity of the cabinet 4 (e.g., for illuminating the contents of the cabinet 4). Configured in this manner, the second light 170 may be recessed relative to the forward opening of the cabinet 4, while still be capable of illuminating the interior of the cabinet 4. Further still, configured in this manner, the second light 170 is configured to provide dual lighting configurations for illuminating a room (i.e., at least when the door is closed) and for illuminating the interior of the cabinet 4 (i.e., when the door is open).

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or resequenced according to alternative embodiments. Other substitutions, modifications, changes and omissions may also be made in the design, operating conditions and arrangement of the various exemplary embodiments without departing from the scope of the present invention.

What is claimed is:

1. A lighting assembly, comprising:

a base;

a first light source coupled to the base; and an elongated lens comprising a U-shaped inner layer comprising a first material and a U-shaped outer layer comprising a second material, the first material being translucent but not transparent and the second material being transparent;

wherein the inner layer and the outer layer are separately formed and coupled to each other; and wherein the inner layer and the outer layer each include a forward end and two spaced-apart sides that extend rearward from the forward end, each side of the inner layer being adjacent one of the sides of the outer layer and the forward end of the inner layer being adjacent the forward end of the inner layer.

2. The lighting assembly according to claim 1, wherein the sides and forward ends of the inner layer and the outer layer are generally planar.

3. The lighting assembly according to claim 1, wherein each side of the inner layer is in contact with one of the sides of the outer layer, and the forward end of the inner layer is in contact with the forward end of the outer layer.

4. The lighting assembly according to claim 3, wherein the inner layer includes a rounded corner between the forward end and each of the sides thereof, the outer layer includes a rounded corner between the forward end and each of the sides thereof, and at least one of the rounded corners of the inner layer is not in contact with the rounded corner of the outer layer adjacent thereto.

5. The lighting assembly according to claim 1, wherein each side of the outer layer includes a rearward end having an inwardly directed flange, each side of the inner layer includes a rearward end abutting the inwardly direct flange of one of the sides of the outer layer, and the forward end of the inner layer abuts the forward end of the outer layer.

6. The lighting assembly according to claim 1, wherein the base includes spaced-apart forwardly extending flanges with inwardly protruding male members, and each side of the outer layer includes an end having a female member configured to receive one of the inwardly protruding male members for coupling the lens to the base.

7. A lighting assembly, comprising:

a base;

a first light source coupled to the base;

an elongated lens comprising a U-shaped inner layer comprising a first material and a U-shaped outer layer comprising a second material, the first material being translucent but not transparent and the second material being transparent; and a translucent end cap coupled to the base or the lens and a second light source that is separately controlled from the first light source, wherein the second light source is disposed in a recess or aperture of the end cap;

wherein the inner layer and the outer layer are separately formed and coupled to each other.

8. The lighting assembly according to claim 7, wherein the translucent end cap includes a projection extending into the cavity defined by the lens.

9. The lighting assembly according to claim 8, wherein the projection is curved and defines a forwardly facing concave surface.

10. A lighting assembly, comprising:

a base;

a first light source coupled to the base; and an elongated lens comprising a U-shaped inner layer comprising a first material and a U-shaped outer layer comprising a second material, the first material being translucent but not transparent and the second material being transparent;

wherein the inner layer and the outer layer are separately formed and coupled to each other; and wherein the first material is diffuses light from the light source, and the second material changes a hue of the light.

11. A lighting assembly, comprising:

a base;

a first light source coupled to the base; and an elongated lens comprising a U-shaped inner layer comprising a first material and a U-shaped outer layer comprising a second material, the first material being translucent but not transparent and the second material being transparent; and a second light source that is separately controlled from the first light source, wherein the second light source is coupled to the base, is elongated, and emits light below the elongated lens;

wherein the inner layer and the outer layer are separately formed and coupled to each other.

12. The lighting assembly according to claim 11, wherein the base includes a flange having a concave surface that is forward of the second light source and that is rearward of the elongated lens, the concave surface being configured to reflect light from the second light source in a downward direction.

13. The lighting assembly according to claim 12, wherein the lighting assembly is configured to mount to a cabinet having a forward opening and a door with a forward surface, such that the second light source is recessed relative to a forward opening of the cabinet and the concave surface of the flange is positioned forward of the forward opening to case light downward and forward of the door.

14. The lighting assembly according to claim 11, wherein the base defines a first forwardly open channel in which the first light source is positioned and a second forwardly open channel in which the second light source is positioned, the second channel having an opening that is below the first opening.

15. The lighting assembly according to claim 14, wherein a flange defines a lower portion of an opening of the first channel and defines an upper portion of an opening of the second channel, the flange being coupled to the elongated lens and defining a concave surface for reflecting light from the second light source downward.

* * * * *